US006848603B2

(12) United States Patent
Gaiser et al.

(10) Patent No.: US 6,848,603 B2
(45) Date of Patent: Feb. 1, 2005

(54) CLOSURE HAVING IMPROVED TAMPER EVIDENT FEATURES

(75) Inventors: Rick Gaiser, Spring Grove, IL (US); Ray Burg, Alsip, IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 169 days.

(21) Appl. No.: 10/197,010

(22) Filed: Jul. 17, 2002

(65) Prior Publication Data

US 2004/0011829 A1 Jan. 22, 2004

(51) Int. Cl.[7] ..... B67B 5/00; B65D 17/40; B65D 39/00

(52) U.S. Cl. ..... 222/153.1; 222/153.01; 222/544; 222/556; 215/237; 215/250; 215/256; 220/276

(58) Field of Search ..... 222/153.1, 153.01, 222/544, 556; 215/235, 237, 250, 256; 220/265, 266, 276

(56) References Cited

U.S. PATENT DOCUMENTS

| | | | | |
|---|---|---|---|---|
| 5,085,333 A | | 2/1992 | Dutt et al. | |
| 5,147,054 A | | 9/1992 | Pehr | |
| 5,174,465 A | | 12/1992 | Luch et al. | |
| 5,386,918 A | * | 2/1995 | Neveras et al. | 215/235 |
| 5,505,325 A | | 4/1996 | Thompson et al. | |
| 6,116,441 A | * | 9/2000 | Decelles et al. | 215/237 |
| 6,216,905 B1 | | 4/2001 | Mogard et al. | |
| 6,347,716 B1 | | 2/2002 | Nofer et al. | |

FOREIGN PATENT DOCUMENTS

| | | |
|---|---|---|
| EP | 0846075 | 8/1996 |
| WO | WO97/08074 | 3/1997 |
| WO | WO 97/33802 | 9/1997 |
| WO | WO 98/57864 | 12/1998 |
| WO | WO 00/76875 | 12/2000 |

* cited by examiner

*Primary Examiner*—Timothy L. Maust
(74) *Attorney, Agent, or Firm*—Knoble Yoshida & Dunleavy, LLC

(57) ABSTRACT

A flip-top type tamper evident closure for dispensing material from a container includes a body portion having a dispensing opening, a lid portion hingedly connected to the body portion and a tamper evident band that is frangibly connected to the body portion. The tamper evident band is constructed and arranged to engage structure on the lid portion in an interlock arrangement in order to retain the lid portion in a closed position prior to the closure first being opened by a consumer. Advantageously, as an additional security measure the tamper evident band is further lightly spot-welded to the lid portion, which prevents or makes evident any attempt to overcome the interlock arrangement. A method of making the closure is also disclosed.

4 Claims, 3 Drawing Sheets

CLOSURE HAVING IMPROVED TAMPER EVIDENT FEATURES

BACKGROUND OF THE INVENTION

1. Field of the Invention

This invention relates generally to the field of packaging and dispensing. More specifically, this invention relates to improved tamper-evident closure for dispensing a viscous foodstuff or other liquids.

2. Description of the Related Technology

Various beverages, foods, medicines and the like are delivered to the public in bottles or other containers that are provided with resealable closures. Such closures provide a benefit to the consumer in that the containers can be tightly sealed and resealed after opening, which prolongs the shelf life of the product and maintains freshness. Although resealable containers provide benefits to consumers, by their nature they permit unauthorized and sometimes undetectable tampering with the product. Accordingly, many modem consumer products are packaged using tamper evident closures, which are designed to make it apparent to a consumer that a container has been opened.

One conventional tamper evident closure 10, which is of the fliptop variety, is depicted in FIG. 1. Closure 10 includes a body portion 12 that is adapted to be secured to a container and that has a dispensing opening 14 defined therein. A lid portion 14 is hingedly mounted to the body portion 12 so as to be movable between a first, closed position as shown in FIG. 1 and a second, open dispensing position. Closure 10 is further provided with a tamper evident band 16 that is frangibly secured to the body portion 12 and that forms an interlock with the lid portion 14 that is designed to prevent opening of the closure prior to removal of the tamper evident band 16. Interlock 18 includes a projection 20 that is integrally molded into the lid portion 14 and that is shaped and sized to contact the underside 22 of the tamper evident band 16 whenever the lid portion 14 is attempted to be opened with the tamper evident band 16 still in place.

Unfortunately, it is possible to overcome the interlock 18 in some circumstances by mechanically prying the tamper evident band 16 away from the lid portion 14 to the extent that the lower surface 22 of the tamper evident band 16 clears the projection 20. This, of course, is undesirable, and a need exists for a closure that provides even a higher degree of tamper evidence and security.

SUMMARY OF THE INVENTION

Accordingly, it is an object of the invention to provide an improved tamper evident closure that provides additional security against displacement of the tamper evident band, as well as providing visible evidence in the event that the tamper evident band becomes significantly manipulated.

In order to achieve the above and other objects of the invention, a closure for dispensing material from a container according to a first aspect of the invention includes a body portion that is adapted to be mounted onto a container and that has a dispensing opening defined therein, a lid portion hingedly connected to the body portion so as to be movable between a first, closed position and a second, open position, a tamper evident band frangibly connected to one of the body portion and the lid portion, the tamper evident band being shaped, sized and positioned to engage structure on the other of the body portion and the lid portion in order to preclude movement of the lid portion away from the first, closed position; and temporary securement structure for temporarily securing the tamper evident band to the other of the body portion and the lid portion, whereby security of the closure prior to opening by a consumer is enhanced.

According to a second aspect of the invention, a method of making a tamper evident closure for dispensing material from a container includes steps of providing a closure component that includes a body portion having a dispensing opening, a lid portion hingedly connected to the body portion and a tamper evident band that is frangibly connected to one of the body portion and the lid portion and is positioned to engage structure on the other of the body portion and the lid portion in order to retain the lid portion in a closed position; and spot welding the tamper evident band to the other of the body portion and the lid portion in order to improve the security that is afforded by the tamper evident band.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 2:
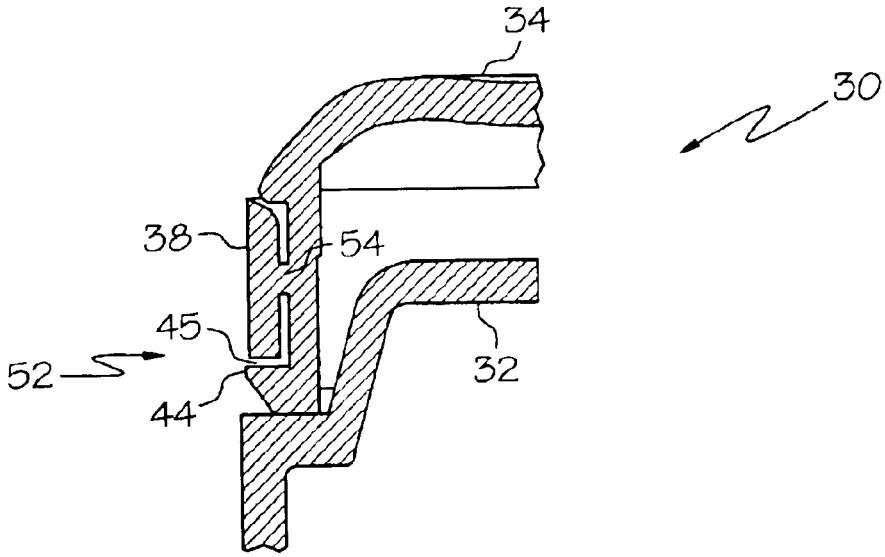
FIG. 2 is a fragmentary cross-sectional view depicting a corresponding portion of a closure that is constructed according to a preferred embodiment of the invention.
Figure 3:
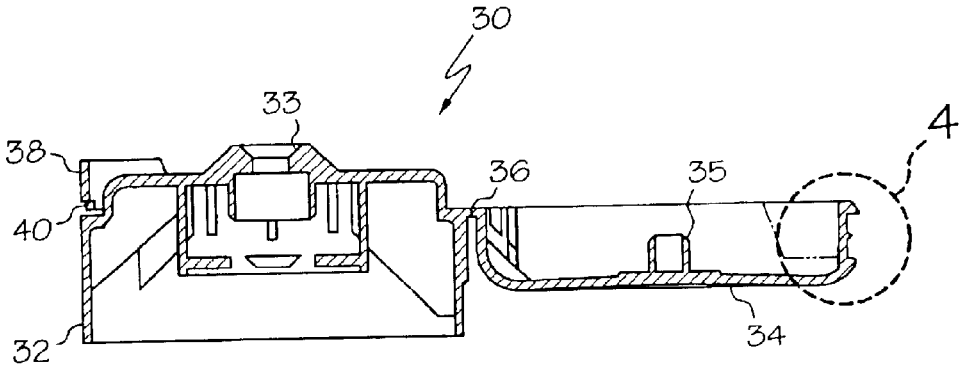
FIG. 3 is a cross-sectional view depicting the closure of FIG. 2, shown in an open, molded position.

Referring now to the drawings, wherein like reference numerals designate corresponding structure throughout the views, and referring in particular to FIG. 2, a closure 30 that is constructed according to a preferred embodiment of the invention includes a body portion 32 that is adapted to be mounted onto a container. Body portion 32 has a dispensing opening 33 defined therein, as is best shown in FIG. 3. Closure 30 further includes a lid portion 34 having an integrally molded plug 35 that is shaped and sized to snap into and seal the dispensing opening 33 when the lid portion 34 is in the closed position. As may be seen in FIG. 3, lid portion 34 is hingedly connected to the body portion 32 by means of a hinge 36. Hinge 36 permits the lid portion 34 to be moved between a first, closed position and a second, open position.

Figure 1:
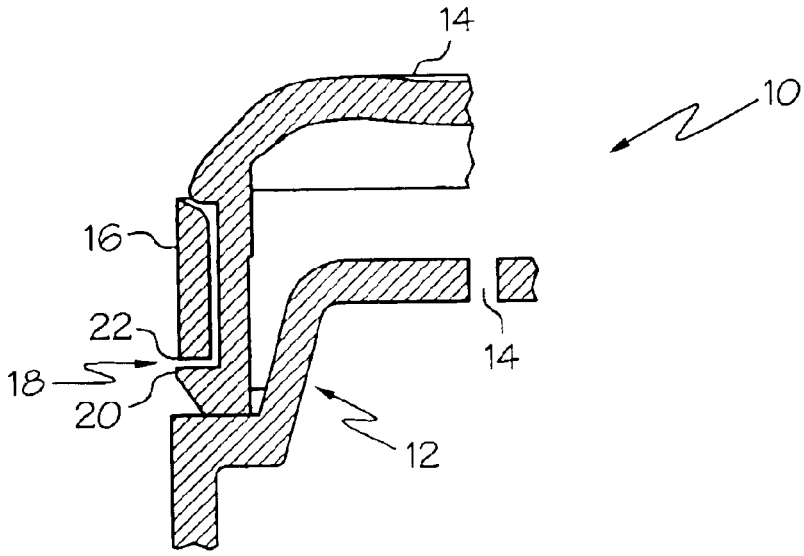
FIG. 1 (PRIOR ART)
FIG. 1 is a fragmentary cross-sectional view depicting a portion of a conventional closure.
Figure 4:
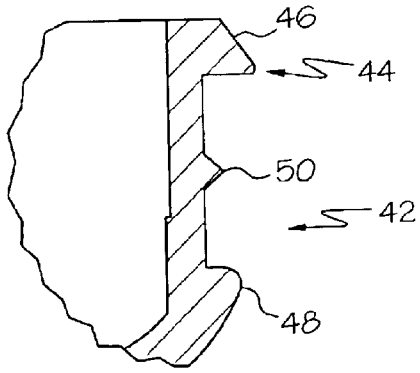
FIG. 4 is a magnified view of a portion of the closure that is depicted in FIG. 3.
Figure 5:
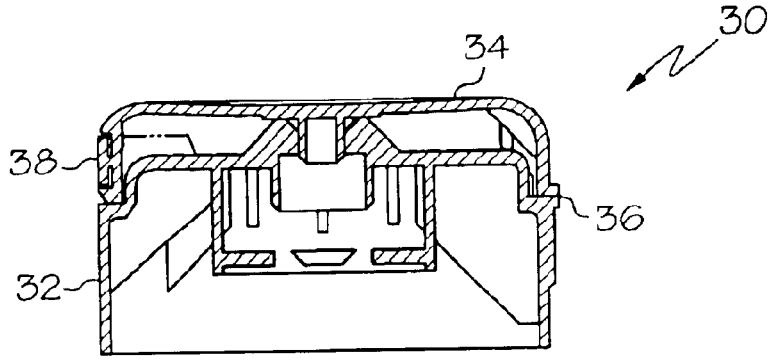
FIG. 5 is a cross-sectional view depicting the closure of FIG. 2, shown in a closed position.

Closure 30 further includes a tamper evident band 38 that is frangibly connected to body portion 12 by means of a plurality of breakable bridges 40. As in the case with the conventional closure that is depicted in FIG. 1, tamper evident band 38 is shaped, sized and positioned to create a mechanical interlock 52 that is designed to prevent opening of the closure 30 prior to removal of the tamper evident band 38. Specifically, as may be seen in FIG. 2, interlock 52 includes a projection 44 that is integrally molded into the lid portion 34 and that is shaped and sized to engage an underside 45 of the tamper evident band 38. As may best be seen in FIG. 4, a circumferential outer surface of a front surface of the lid portion 34 is shaped so as to define a recessed area 42 that is defined by a recessed portion of the front surface, the projection 44 and an upper projection 48. Recessed area 42 is preferably shaped and sized so as to receive the tamper evident band 38 in a manner such that the outer surface of the tamper evident band 38 will be substantially flush with the outermost portions of the projections 44, 48. As may further be seen in FIG. 4, projection 44 includes a ramped surface 46 that is sloped so as to permit assembly of the closure 30 by closing the lid 34 from the open position shown in FIG. 3 to the closed position that is shown in FIG. 5. During closing, the ramped surface 46 of the projection 44 will first contact a chamfered upper surface of the tamper evident band 38, and then be guided radially inwardly of the tamper evident band 38 until the tamper evident band 38 clears the projection 44 and snaps into place within the recessed area 42. Preferably, the entire closure 30 as it is depicted in its open, molded position in FIG. 3 is a molded as a single, unitary piece from a suitable plastic material such as polyethylene or polypropylene.

According to one important aspect of the invention, closure 30 is further preferably provided with temporary securement structure 54 for temporarily securing the tamper evident band 38 to the lid portion 14 prior to the first opening of the closure 30 by a consumer. The presence of the temporary securement structure 54 makes it more difficult to defeat interlock 52 by mechanically prying the tamper evident band 38 away from the projection 44. In addition, temporary securement structure 54 will provide a visual indication of whether there has been an attempt to significantly manipulate the tamper evident band with respect to the lid portion 34, as would occur during efforts to overcome the interlock 52.

Figure 6:
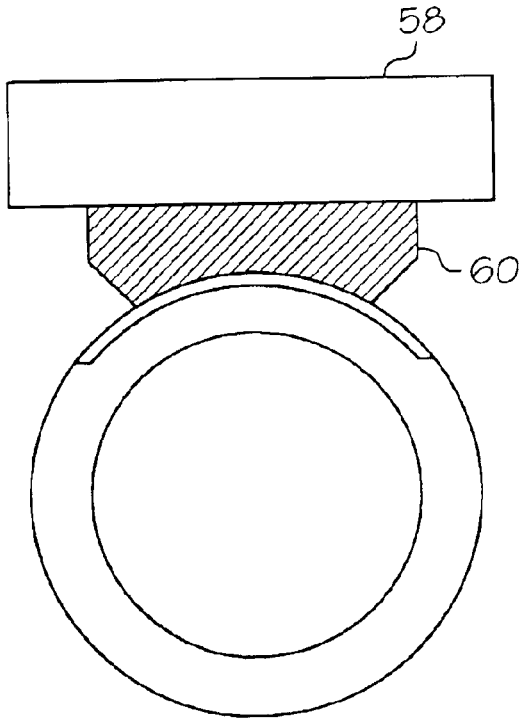
FIG. 6 is a diagrammatical depiction of a final step in a process that is performed according to the preferred embodiment of the invention.

In the preferred embodiment, temporary securement structure 54 is constructed as a plurality of spot welds, which could be created according to any one of several known manufacturing processes. Alternatively, temporary securement structure 54 could be embodied as an adhesive or one or more mechanically applied frangible elements. As may be seen in FIG. 4, in the preferred embodiment temporary securement structure 54 is provided by molding a plurality of plastic beads 50 into the recessed sidewall of the recessed area 42 that is defined in lid portion 34. As may be seen in FIG. 4, beads 50 are preferably substantially conical in shape, being tapered so as to have a pointed end facing radially outwardly. Preferably, beads 50 are positioned so as to be substantially evenly spaced along the interface between the tamper evident band 38 and the recessed area 42. After assembly of the closure 30 in the closed position as described above, a horn member 60 of an ultrasonic transducer 58 is brought into physical contact with the outer circumferential surface of the tamper evident band 38, as shown in FIG. 6. Horn member 60 is preferably shaped so as to complement the shape of the outer periphery of the tamper evident band 38. The ultrasonic energy that is supplied by the transducer 58 will be focused by the shape of the tamper evident band 38 and the shape of the beads 50 into the area of contact between those two elements, whereby creating a spot weld that will lightly releasably affix the tamper evident band 38 to the lid portion 34.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A closure for dispensing material from a container, comprising:

a body portion that is adapted to be mounted onto a container, said body portion having a dispensing opening defined therein;

a lid portion hingedly connected to said body portion so as to be movable between a first, closed position and a second, open position;

a tamper evident band frangibly connected to said body portion, said tamper evident band being shaped, sized and positioned to engage structure on said lid portion in order to preclude movement of said lid portion away from said first, closed position, said structure on said lid portion comprising a projection extending radially outwardly from said lid portion, said projection being shaped, sized and positioned to engage an underside of said tamper evident band; and temporary securement means for temporarily securing said tamper evident band to said lid portion, whereby security of said closure prior to opening by a consumer is enhanced.

2. A closure for dispensing material from a container according to claim 1, wherein said temporary securement means comprises at least one spot weld frangibly connecting said tamper evident band to said lid portion.

3. A closure for dispensing material from a container according to claim 2, wherein said temporary securement means comprises a plurality of spot welds frangibly connecting said tamper evident band to said lid portion.

4. A closure for dispensing material from a container according to claim 3, wherein said temporary securement means is further configured so that said spot welds are spaced substantially regularly along an area of interface between said tamper evident band and said lid portion.

* * * * *